US011465835B2

(12) United States Patent
Hamad et al.

(10) Patent No.: US 11,465,835 B2
(45) Date of Patent: Oct. 11, 2022

(54) DUAL DRAWTAPE TRASH BAGS HAVING IMPROVED ELASTIC AND STIFFNESS PERFORMANCE

(71) Applicant: Dow Global Technologies LLC, Midland, MI (US)

(72) Inventors: Fawzi G. Hamad, Lake Jackson, TX (US); Mustafa Bilgen, Manvel, TX (US); Jose Eduardo Ruiz, Lake Jackson, TX (US); Jon W. Hobson, Freeport, TX (US)

(73) Assignee: Dow Global Technologies LLC, Midland, MI (US)

( * ) Notice: Subject to any disclaimer, the term of this patent is extended or adjusted under 35 U.S.C. 154(b) by 368 days.

(21) Appl. No.: 16/626,699

(22) PCT Filed: Jul. 17, 2018

(86) PCT No.: PCT/US2018/042453

§ 371 (c)(1),
(2) Date: Dec. 26, 2019

(87) PCT Pub. No.: WO2019/006477

PCT Pub. Date: Jan. 3, 2019

(65) Prior Publication Data

US 2021/0284438 A1 Sep. 16, 2021

Related U.S. Application Data

(60) Provisional application No. 62/527,422, filed on Jun. 30, 2017.

(51) Int. Cl.
*B65F 1/00* (2006.01)

(52) U.S. Cl.
CPC ..... *B65F 1/002* (2013.01); *B65F 2250/1143* (2013.01)

(58) Field of Classification Search
CPC ... B65F 1/002; B65F 2250/1143; B65D 33/28
USPC ..... 383/75
See application file for complete search history.

(56) References Cited

U.S. PATENT DOCUMENTS

| | | | |
|---|---|---|---|
| 2,851,712 | A | 9/1958 | Howard |
| 5,006,380 | A | 4/1991 | Fraser |
| 5,133,607 | A | 7/1992 | Bonke |
| 6,059,458 | A | 5/2000 | Belias et al. |
| 6,939,042 | B2 | 9/2005 | Rusnak et al. |
| 7,520,673 | B2 | 4/2009 | Bonke |
| 8,167,490 | B2 | 5/2012 | Hu et al. |

(Continued)

OTHER PUBLICATIONS

Examination Report dated Jan. 25, 2022, pertaining to European Patent Application No. 18765221.9.

(Continued)

*Primary Examiner* — Jes F Pascua
(74) *Attorney, Agent, or Firm* — Dinsmore & Shohl LLP

(57) ABSTRACT

Embodiments of thermoplastic bags which yield elasticity and stiffness include a first drawtape disposed within the first channel, wherein the first drawtape comprises a linear low density polyethylene having a density of from 0.902 g/cc to 0.920 g/cc, and a second drawtape disposed within the second channel, wherein the second drawtape comprises a high density polyethylene having a density of from 0.940 g/cc to 0.965 g/cc.

10 Claims, 7 Drawing Sheets

(56) References Cited

U.S. PATENT DOCUMENTS

| | | | | |
|---|---|---|---|---|
| 9,586,726 | B1 | 3/2017 | Moody et al. | |
| 2005/0063622 | A1 | 3/2005 | Kannabiran | |
| 2010/0172602 | A1 | 7/2010 | O'Donnell et al. | |
| 2011/0002559 | A1 | 1/2011 | Wood et al. | |
| 2011/0052103 | A1* | 3/2011 | Hall | B65F 1/0006 383/75 |
| 2011/0255809 | A1* | 10/2011 | Tucker | B65D 33/02 383/119 |
| 2012/0057811 | A1* | 3/2012 | Tucker | B65D 31/04 383/72 |
| 2012/0121213 | A1 | 5/2012 | Ross | |
| 2014/0056544 | A1 | 2/2014 | Moras et al. | |
| 2014/0254958 | A1 | 9/2014 | Cobler | |
| 2015/0259104 | A1 | 9/2015 | Cobler | |
| 2015/0344190 | A1* | 12/2015 | Tseng | B65F 1/002 24/30.5 R |
| 2016/0046412 | A1 | 2/2016 | Kent et al. | |

OTHER PUBLICATIONS

International Search Report and Written Opinion pertaining to PCT/US2018/042453, dated Nov. 29, 2018.

Japanese Notice of Reasons fo Refusal dated Jul. 5, 2022, pertaining to JP Patent Application No. 2019-568651, 4 pgs.

* cited by examiner

DUAL DRAWTAPE TRASH BAGS HAVING IMPROVED ELASTIC AND STIFFNESS PERFORMANCE

CROSS REFERENCE TO RELATED APPLICATION

This application is a National Stage Entry under 35 U.S.C. § 371 of International Patent Application No. PCT/US2018/042453 filed Jul. 17, 2018, which claims priority to U.S. Provisional Patent Application No. 62/527,422 filed Jun. 30, 2017, entitled DUAL DRAWTAPE TRASH BAGS HAVING IMPROVED ELASTIC AND STIFFNESS PERFORMANCE, the contents of which are hereby incorporated by reference in their entirety.

TECHNICAL FIELD

Embodiments described herein relate generally in trash bags having dual draw tapes, and specifically related to trash bags having an elastic drawtape and a standard drawtape comprising high density polyethylene.

BACKGROUND

There are typically two types of drawtape found in commercial consumer trash bags: standard drawtape and elastic drawtape. Both types of drawtape found in commercial liner bags have drawbacks. Liner bags with standard drawtape have good load carrying capability i.e., the drawtape strip does not elongate excessively or break upon lifting heavy weights. However, standard draw tapes are harder to open and often fail to grip to the trash can, resulting in the bag collapsing into the receptacle when a heavy weight is placed. Elastic drawtape does grip well to the trash receptacle and holds up the weight. However, elastic drawtape elongates extensively and excessively, which is an inconvenience for consumers when carrying the trash bag.

Accordingly, there is a need for trash bags which synergistically combine the benefits of the standard drawtape and the elastic drawtape.

SUMMARY

Embodiments of the present disclosure meet those needs by providing thermoplastic bags having dual drawtapes, which enable the trash bags to have a desired balance of elasticity and stiffness. Specifically, one side of the liner hem of the trash bag houses a linear low density polyethylene (LLDPE) film that provides the elastic properties for easy opening and better gripping of the liner bag onto the trash receptacle. The other side of the liner hem holds a high density polyethylene (HDPE) film for good stiffness and tensile performance when carrying the bag.

According to at least one embodiment of the present disclosure, a thermoplastic bag is provided. The thermoplastic bag comprises a first panel and a second panel, the first panel and the second panel joined together at a first side edge, a second side edge, and a bottom edge. The first panel and the second panel define an opening along respective top edges of the first panel and the second panel and define a closed end along the bottom edge. The thermoplastic bag also comprises a first hem defining a first channel, the first hem being formed along the top edge of the first panel. The thermoplastic bag further comprises a second hem defining a second channel, the second hem being formed along the top edge of the second panel. Moreover, the thermoplastic bag also comprises a first drawtape disposed within the first channel, wherein the first drawtape comprises a linear low density polyethylene having a density of from 0.902 g/cc to 0.920 g/cc, and a second drawtape disposed within the second channel, wherein the second drawtape comprises a high density polyethylene having a density of from 0.940 g/cc to 0.965 g/cc.

These and other embodiments are described in more detail in the following Detailed Description in conjunction with the appended drawings.

BRIEF DESCRIPTION OF THE DRAWINGS

The following detailed description of specific embodiments of the present disclosure can be best understood when read in conjunction with the following drawings, where like structure is indicated with like reference numerals and in which.

DETAILED DESCRIPTION

Specific embodiments of the present application will now be described. The disclosure may, however, be embodied in different forms and should not be construed as limited to the embodiments set forth in this disclosure. Rather, these embodiments are provided so that this disclosure will be thorough and complete, and will fully convey the scope of the subject matter to those skilled in the art.

The term "polymer" refers to a polymeric compound prepared by polymerizing monomers, whether of the same or a different type. The generic term polymer thus embraces the term "homopolymer", usually employed to refer to polymers prepared from only one type of monomer as well as "copolymer" which refers to polymers prepared from two or more different monomers. The term "interpolymer," as used herein, refers to a polymer prepared by the polymerization of at least two different types of monomers. The generic term interpolymer thus includes copolymers, and polymers prepared from more than two different types of monomers, such as terpolymers.

"Polyethylene" or "ethylene-based polymer" shall mean polymers comprising greater than 50% by weight of units which have been derived from ethylene monomer. This includes polyethylene homopolymers or copolymers (meaning units derived from two or more comonomers). Common forms of polyethylene known in the art include Low Density Polyethylene (LDPE); Linear Low Density Polyethylene (LLDPE); Ultra Low Density Polyethylene (ULDPE); Very Low Density Polyethylene (VLDPE); single-site catalyzed Linear Low Density Polyethylene, including both linear and substantially linear low density resins (m-LLDPE); Medium Density Polyethylene (MDPE); and High Density Polyethylene (HDPE).

"Standard drawtape" and "high density drawtape" are used synonymously and refer to drawtape comprising HDPE having a density of 0.940 to 0.965 g/cc.

As used herein, "multilayer draw tapes" refer to structures having multiple layers generally formed via coextrusion. In contrast, "monolayer draw tapes" are single layer films. As used herein, "dual drawtape" refers to the embodiments of the present disclosure which have LLDPE film on one liner hem, and HDPE film at another liner hem.

Figure 1:
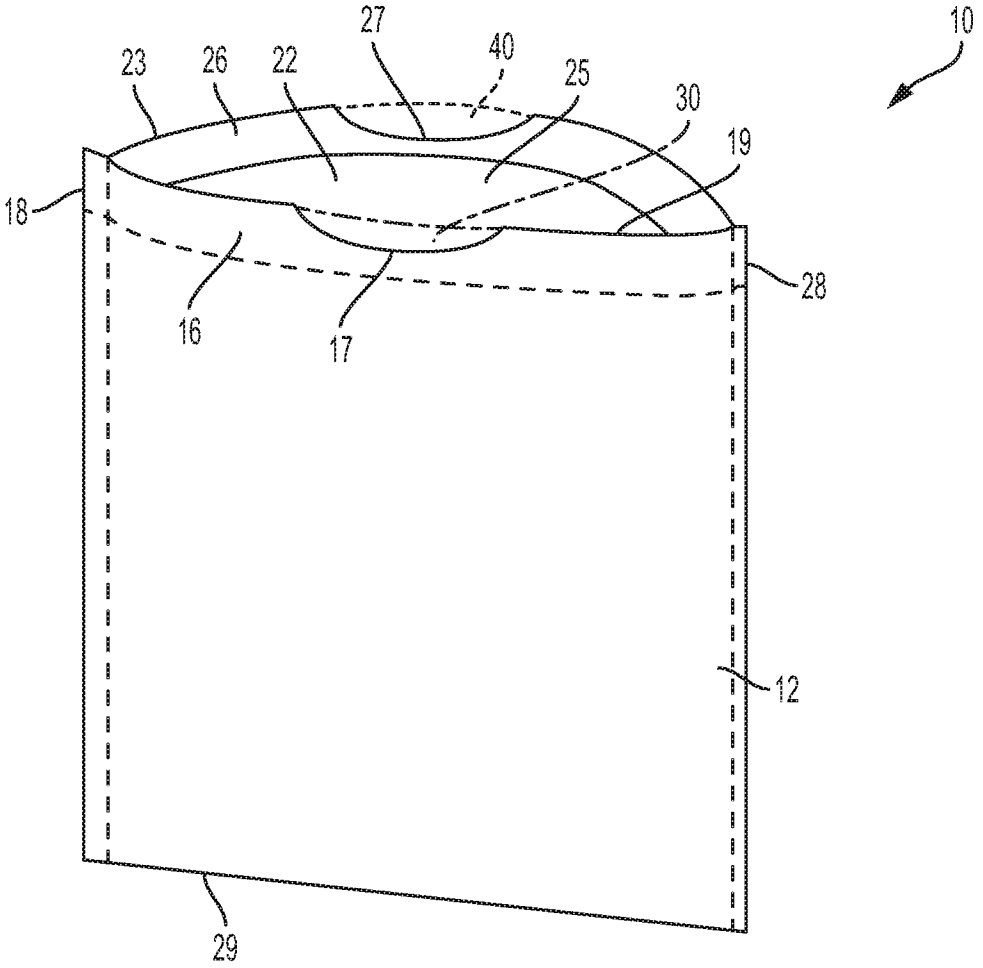
FIG. 1 is a schematic depiction of dual drawtape trash bag in accordance with one or more embodiments of the present disclosure.

Reference will now be made in detail to various thermoplastic bag embodiments of the present disclosure. Referring to FIG. 1, the thermoplastic bag 10 comprises a first panel 12 and a second panel 22. The first panel 12 and the second panel 22 are joined together at a first side edge 18, a second side edge 28, and a bottom edge 29. The first panel 12 and the second panel 22 define an opening 25 along respective top edges 19, 23 of the first panel 12. Moreover, the first panel 12 and the second panel 22 define a closed end due to the first panel 12 and the second panel 22 being joined along the bottom edge 29.

Referring again to FIG. 1, the thermoplastic bag 10 comprises a first hem 16 is formed along the top edge 19 of the first panel 12. Moreover, the thermoplastic bag 10 comprises a second hem 26 formed along the top edge 23 of the second panel 22. As shown, the first hem 16 is a thermoplastic flap extending from the top edge 19 of the first panel 12 and sealed to the first panel 12, such that a first channel is formed between the first hem 16 and the first panel 12. Similarly, the second hem 26 is a thermoplastic flap extending from the top edge 23 of the second panel 22 and sealed to the second panel 22, such that a second channel is formed between the second hem 26 and the second panel 22.

The thermoplastic bag 10 comprises a first drawtape 30 disposed within the first channel and a second drawtape 40 disposed within the second channel. Moreover, the first panel 12 has a first drawtape access hole 17 located along the top edge 19 of the first panel 12. The first drawtape access hole 17 permits exterior access to the first drawtape 30. The second panel 22 has a second drawtape access hole 27 located along the top edge 23 of the second panel 22. The second drawtape access hole 27 permits exterior access to the second drawtape 40.

Various methods for producing the thermoplastic bags would be familiar to one of ordinary skill in the art. For example, the first panel 12, the second panel 22, and/or the first drawtape 12 and second drawtape 22 may undergo surface modification, such as, ring rolling, machine direction orientation (MDO) stretching, or embossing.

The first drawtape 30, which may be considered as the elastic drawtape, comprises a linear low density polyethylene (LLDPE) having a density of from 0.902 g/cc to 0.920 g/cc. The second drawtape 40 comprises a high density polyethylene having a density of from 0.940 g/cc to 0.965 g/cc. In one embodiment, the first drawtape 30, the second drawtape 40, or both comprise monolayer films. In specific embodiments, both the first drawtape 30 and the second drawtape 40 are monolayer films. In alternative embodiments, one or both of the first drawtape 30 and the second drawtape 40 may include multilayer films.

In further embodiments of the first drawtape, the LLDPE may have a density of from 0.902 g/cc to 0.918 g/cc, or from 0.902 to 0.915 g/cc. Moreover, the LLDPE may have a melt index, $I_2$, of less than 10 g/10 min when measured according to ASTM D1238 at 190° C. and 2.16 kg load. In further embodiments, specifically in embodiments wherein the first drawtape is a blown film, the LLDPE may have a melt index, $I_2$, of 0.1 to 2 g/10 min, or from 0.5 to 1.5 g/10 min. For cast film embodiments, the LLDPE may have a melt index greater than 2 g/10 min.

The first drawtape may comprise greater than 55 wt. % LLDPE based on the total weight of polymers present in the first drawtape, or greater than 65 wt. %, greater than 75 wt. %, greater than 80 wt. %, greater than 90 wt. %, or greater than 95 wt. %. In another embodiment, the first drawtape may consist of LLDPE.

In further embodiments of the second drawtape, the HDPE may have a density of from 0.945 g/cc to 0.965 g/cc. Moreover, in other embodiments of the second drawtape, the high density polyethylene may have a melt index, $I_2$, of 0.01 to 1 g/10 min, or from of 0.05 to 1 g/10 min.

The second drawtape may comprise greater than 55 wt. % HDPE based on the total weight of polymers present in the second drawtape, or greater than 65 wt. %, greater than 75 wt. %, greater than 80 wt. %, greater than 90 wt. %, or greater than 95 wt. %. In another embodiment, the second drawtape may consist of HDPE.

Testing Methods

The test methods include the following:

Melt Index ($I_2$)

Melt index ($I_2$) were measured in accordance to ASTM D-1238 at 190° C. at 2.16 kg. The values are reported in g/10 min, which corresponds to grams eluted per 10 minutes.

Density

Samples for density measurement were prepared according to ASTM D4703 and reported in grams/cubic centimeter (g/cc or g/cm$^3$). Measurements were made within one hour of sample pressing using ASTM D792, Method B.

EXAMPLES

The following examples illustrate features of the present disclosure but are not intended to limit the scope of the disclosure. The following experiments compared the performance of dual drawtapes with conventional drawtapes based on the following parameters: 1) ease of opening; 2) percent elastic recovery; and 3) load carrying capability.

Protocol

Experimental results were gathered using an Instron instrument, testing for both the elasticity and rigidity of a drawtape. Elastic performance of a drawtape was measured using a modified Stretch Hooder 60/40 experiment (ASTM D-4649). To test the rigidity of a film, a standard tensile test (ASTM D882) was performed and measured the load as a function of strain. Both methods are described in more detail below.

Since the dual drawtape concept involves two separate films, an elastic film and a high density film, those two films were sealed together prior to performing any Instron experiments. The seal protocol implemented is similar to the Heat Seal Strength procedure (ASTM F88), with the following steps:

1. 8×8 inch samples of each elastic and high density film were cut.

2. Both samples were sealed along the cross-direction of the film (all tensile test were performed in machine direction), with seal conditions of the following Table 1

TABLE 1

| Seal Conditions | |
|---|---|
| Dwell time | 0.6 seconds |
| Pressure | 60 psi |
| Seal temperature | 110-122° C. |

3. Samples were then conditioned for at least 24 hrs. and were then cut into 1 inch strips in the machine direction.

To test for standard drawtapes, films were individually tested without sealing.

The modified Stretch Hooder 60/40 test included changing the percent strain from 60/40 to 12/6 and the holding time from 15 second to 2 second, respectively. Experiments were performed as follows:

1. 1 inch sample strips (sealed and individual films) were pulled in the machine direction on the Instron with a 5 inch grip separation.

2. The sample strips were stretched to 12% strain at a speed of 20 in/min and was held for 2 seconds. The crosshead then returned to 6% strain and holds for 100 seconds.

3. The strain then returned back to 0%.

Data gathered from this experiment was used to calculate the elastic recovery of the film, i.e. how much strain is recovered after the load applied to stretch the film is released.

Tensile tests were performed using the following standard method:

1. 1 inch sample strips were pulled in the machine direction on the Instron.

2. The sample was continuously stretched at a speed of 20 in/min until it breaks.

Application tests designed to test the elastic and rigid properties of the drawtape inside a trash bag were also performed. Procedures are explained in detail below.

Figure 2:
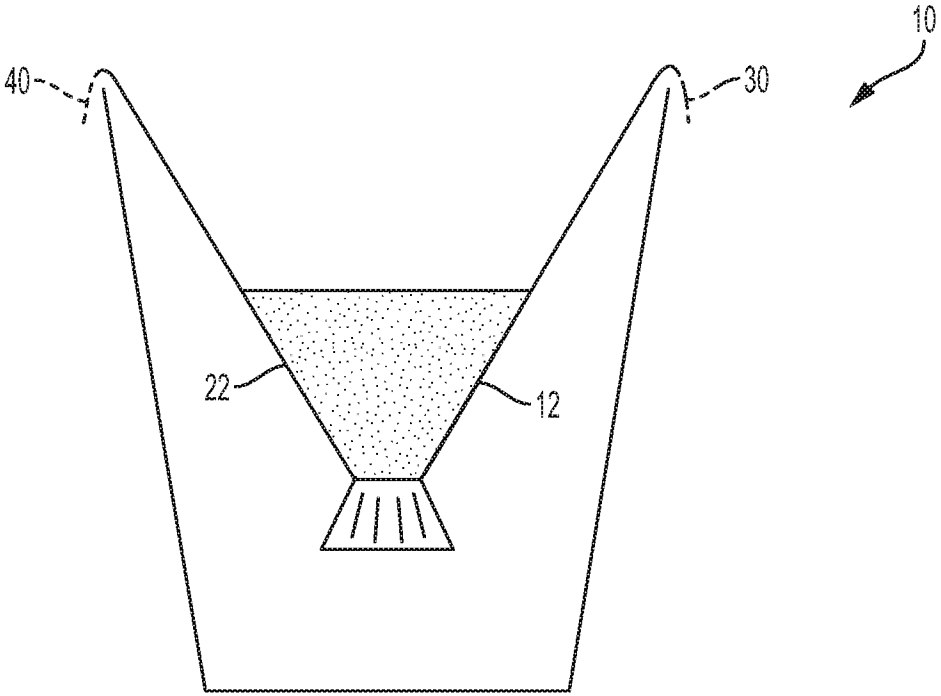
FIG. 2 is a schematic depiction of a dual drawtape trash bag when gripped onto a trash receptacle in accordance with one or more embodiments of the present disclosure.

The drawtape gripping to trash receptacle test is a pass/fail test, which is performed as follows:

1. A knot is tied in the middle of the commercial liner trash bag (see FIG. 2)

2. The liner trash bag is placed in the trash receptacle, making sure that the drawtape within the hem fits tightly onto the trash can wall.

3. A 20 lbs. weight is placed in the trash bag. The knot initially made keeps the weight suspended when placed in the trash bag, focusing all the weight of the bag onto the drawtapes.

4. After 2 minutes, it is observed whether the drawtape still grips onto the trash can. If drawtape holds up the placed weight for the allotted period, then it passes. If the drawtape was not able to lift the weight and the liner trash bag collapses into the can, then it was considered a fail.

Figure 3:
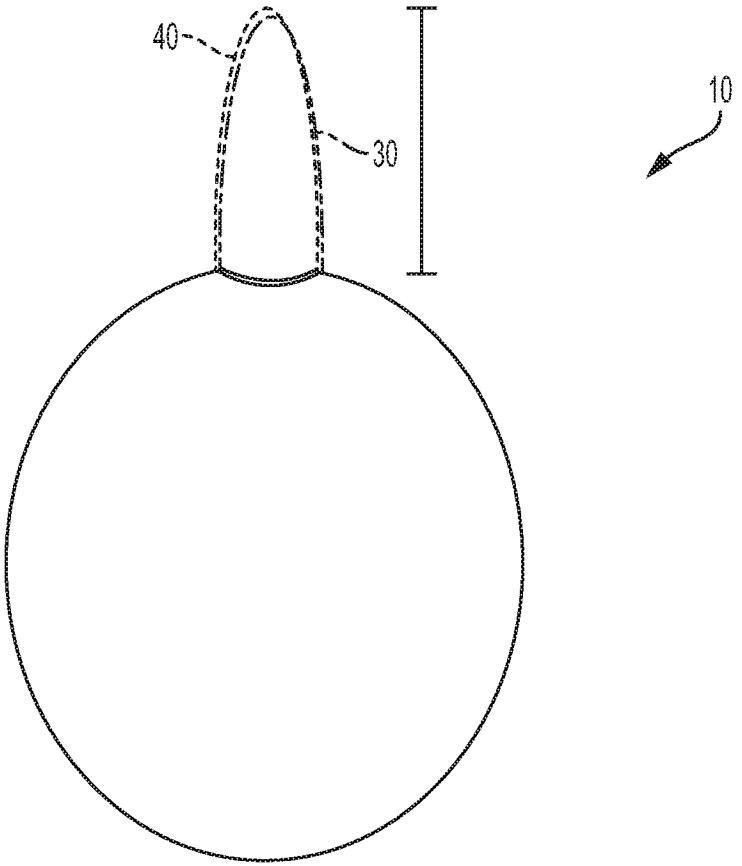
FIG. 3 is a schematic depiction of a dual drawtape trash bag when the dual draw tapes are elongated for sealing in accordance with one or more embodiments of the present disclosure.

To find the tensile performance of a drawtape, the length of the drawtape was measured before and after placing a weight in the trash bag. The steps to measure the tensile performance were as follows:

1. As shown in FIG. 3, the draw tapes housed within the hems were pulled out, until the opening of the liner trash bag is bundled up and closed. The end-to-end length is measured and noted as the initial length.

2. The trash bag liner was reopened to place a 20 lbs. weight.

3. The trash bag was lifted off the ground and the drawtape films were hung onto a hook, placing the stress of the weight onto the drawtape.

4. After 2 minutes, the same end-to-end length was measured while the film was still under tension.

5. The percent elongation was calculated using the initial and final drawtape length.

In order for a drawtape to remain easy to stretch and place over a trash can, the recommended stretch load value should remain below 5 lbs. When performing the gripping test, the drawtape needs to hold tight onto the trash can walls while carrying the weight in the bag. The recommended percent elastic recovery (from the Stretch Hooder experiment) for the drawtape should be at least 75%.

In the present experiments, the gripping application test was conducted 4 times for each drawtape, and in order for the drawtape to pass, it needs to hold onto the trash receptacle each time without collapsing.

Internal studies have shown the drawtape film should not elongate beyond 30% when carrying a 20 lbs. weight, as this might cause the trash bag to drag on the floor, becoming an inconvenience for consumers.

Drawtape Samples

For these experiments, 3 high density resins, and 4 elastic resins were utilized in various samples. These compositions are summarized in Table 2 below. As shown in FIGS. 4-7, trash bags having solely high density monolayer films were tested as were trash bags having solely elastic monolayer films. Additionally, dual drawtape trash bags having a high density monolayer film in one liner hem and an elastic monolayer film in the other liner hem were also studied.

The drawtape films inserted into the liner bags were 1 inch wide. The converting machine typically requires a 2 inch wide drawtape film roll which gets slit in half during the process before each drawtape is inserted into its respective hem. For the dual drawtape embodiments, the equipment procedure was modified to insert two different drawtape films of 1 inch. The required changes were mainly in the beginning portion of the process, starting from the film leaving the roll and continuing until the two drawtapes followed separate paths to their respective bag panel. The main difference over conventional processes included having two film rolls of 1 inch running simultaneously through the rolls, thereby maintaining good tension on both the high density film and elastic film. Both films of 1" were run side by side until they reached the section where the films diverged to take separate paths.

TABLE 2

| Draw Tape Compositions | | | |
|---|---|---|---|
| Resin | Melt Index ($I_2$) | Density (g/cc) | Supplier |
| Elastic Resins | | | |
| Exceed ™ 1018H | 1 | 0.918 | Exxon Mobil Corporation |
| Elastic Resin 1 | 0.85 | 0.912 | N/A |
| DOWLEX ™ 2045G | 1 | 0.92 | The Dow Chemical Company (Midland, MI) |
| Affinity 1880G | 0.75 | 0.902 | The Dow Chemical Company |

TABLE 2-continued

| Draw Tape Compositions | | | |
|---|---|---|---|
| Resin | Melt Index ($I_2$) | Density (g/cc) | Supplier |
| | | | (Midland, MI) |
| High Density Resins | | | |
| DGDC-2100 NT 7 | 0.07 | 0.948 | The Dow Chemical Company (Midland, MI) |
| ELITE 5960G | 0.85 | 0.962 | The Dow Chemical Company (Midland, MI) |
| UNIVAL DMDG-6200 NT | 0.4 | 0.953 | The Dow Chemical Company (Midland, MI) |

All films were fabricated on the Lab Tech 5-Layer Lab-Scale Blown Film process. The line was equipped with a 3 inch die with an estimated specific output of 3-6 lbs/hr/in of die circumference based on bubble stability. The processing conditions are summarized in Table 3 below.

TABLE 3

| | |
|---|---|
| Blow-Up Ratio | 1:2 |
| Gauge (mil) | 3.0 |
| Gauge Variation (%) | 8.7 |
| Melt Temperature (F.) | 410-480 |

Process for Making Elastic Resin 1

In the production of Elastic Resin 1 from Table 2, all raw materials (monomer and comonomer) and the process solvent (a narrow boiling range high-purity isoparaffinic solvent, Isopar-E) were purified with molecular sieves before introduction into the reaction environment. Pressurized hydrogen was supplied as a high purity grade and was not further purified. The reactor monomer feed stream was pressurized via a mechanical compressor to above reaction pressure. The solvent and comonomer feed were pressurized via a pump to above reaction pressure. The individual catalyst components were manually batch diluted with purified solvent and pressurized to above reaction pressure. All reaction feed flows were measured with mass flow meters and independently controlled with computer automated valve control systems.

A two reactor system was used in a series configuration. Each continuous solution polymerization reactor consisted of a liquid full, non-adiabatic, isothermal, circulating, loop reactor which mimics a continuously stirred tank reactor (CSTR) with heat removal. Independent control of all fresh solvent, monomer, comonomer, hydrogen, and catalyst component feeds was possible. The total fresh feed stream to the each reactor (solvent, monomer, comonomer, and hydrogen) was temperature controlled to maintain a single solution phase by passing the feed stream through a heat exchanger. The total fresh feed to each polymerization reactor was injected into the reactor at two locations with approximately equal reactor volumes between each injection location. The fresh feed was controlled with each injector receiving half of the total fresh feed mass flow. The catalyst components were injected into each polymerization reactor through specially designed injection stingers. The primary catalyst component feed was computer controlled to maintain each reactor monomer conversion at the specified targets. The cocatalyst components were fed based on calculated specified molar ratios to the primary catalyst component. Immediately following each reactor feed injection location, the feed streams were mixed with the circulating polymerization reactor contents with static mixing elements. The contents of each reactor were continuously circulated through heat exchangers responsible for removing much of the heat of reaction and with the temperature of the coolant side responsible for maintaining an isothermal reaction environment at the specified temperature. Circulation around each reactor loop was provided by a pump.

The effluent from the first polymerization reactor (containing solvent, monomer, comonomer, hydrogen, catalyst components, and polymer) exited the first reactor loop and was added to the second reactor loop. The final reactor effluent (second reactor effluent for dual series configuration) entered a zone where it was deactivated with the addition of and reaction with a suitable reagent (water). At this same reactor exit location, other additives, such as antioxidants were added for polymer stabilization. Typical antioxidants suitable for stabilization during extrusion and blown film fabrication include Irganox® 1067, Irgafos® 168, and Irganox® 1010 all supplied by BASF.

Following catalyst deactivation and additive addition, the reactor effluent entered a devolatization system where the polymer was removed from the non-polymer stream. The isolated polymer melt was pelletized and collected. The non-polymer stream passes through various pieces of equipment which separate most of the ethylene which was removed from the system. Most of the solvent and unreacted comonomer was recycled back to the reactor system after passing through a purification system. A small amount of solvent and comonomer was purged from the process.

The reactor stream feed data and process parameters are provided in Table 4 below.

TABLE 4

| Elastic Resin 1 process parameters | | |
|---|---|---|
| Process Parameter | Unit or Type | Value |
| Reactor Configuration | Type | Dual Series |
| Comonomer type | Type | 1-octene |
| First Reactor Feed Solvent/ Ethylene Mass Flow Ratio | g/g | 4.9 |
| First Reactor Feed Comonomer/ Ethylene Mass Flow Ratio | g/g | 0.39 |
| First Reactor Feed Hydrogen/ Ethylene Mass Flow Ratio | g/g | 1.8E−04 |
| First Reactor Temperature | ° C. | 145 |
| First Reactor Pressure | Bar | 50 |
| First Reactor Ethylene Conversion | % | 85.9 |
| First Reactor Catalyst Type | Type | Zirconium,dimethyl[[2,2'''-[1,3- |

TABLE 4-continued

| Elastic Resin 1 process parameters | | |
|---|---|---|
| Process Parameter | Unit or Type | Value |
| | | propanediylbis(oxy-κO)]bis[3'',5,5''-tris(1,1-dimethylethyl)-5'-methyl[1,1':3',1''-terphenyl]-2'-olato-κO]](2-)] |
| First Reactor Co-Catalyst 1 Type | Type | Bis(hydrogenated tallow alkyl)methyl, tetrakis(pentafluorophenyl) borate(1-) amine |
| First Reactor Co-Catalyst 2 Type | Type | Modified methylalumoxane |
| First Reactor Co-Catalyst 1 to Catalyst Molar Ratio (B to Zr ratio) | Ratio | 1.6 |
| First Reactor Co-Catalyst 2 to Catalyst Molar Ratio (Al to Zr ratio) | Ratio | 30.4 |
| First Reactor Residence Time | Min | 9.2 |
| Second Reactor Feed Solvent/ Ethylene Mass Flow Ratio | g/g | 2.5 |
| Second Reactor Feed Comonomer/ Ethylene Mass Flow Ratio | g/g | 0.096 |
| Second Reactor Feed Hydrogen/ Ethylene Mass Flow Ratio | g/g | 1.5E−04 |
| Second Reactor Temperature | ° C. | 195 |
| Second Reactor Pressure | Barg | 50 |
| Second Reactor Ethylene Conversion | % | 83.1 |
| Second Reactor Catalyst Type | Type | Zirconium,dimethyl[[2,2'''-[1,3-propanediylbis(oxy-κO)]bis[3'',5,5''-tris(1,1-dimethylethyl)-5'-methyl[1,1':3',1''-terphenyl]-2'-olato-κO]](2-)] |
| Second Reactor Co-Catalyst 1 Type | Type | Bis(hydrogenated tallow alkyl)methyl, tetrakis(pentafluorophenyl) borate(1-) amine |
| Second Reactor Co-Catalyst 2 Type | Type | Modified methylalumoxane |
| Second Reactor Co-Catalyst 1 to Catalyst Molar Ratio (B to Zr ratio) | mol/mol | 1.2 |
| Second Reactor Co-Catalyst 2 to Catalyst Molar Ratio (Al to Zr ratio) | mol/mol | 15.0 |
| Second Reactor Residence Time | Min | 6.4 |

To demonstrate the improved properties of the dual drawtape embodiments. Other comparative films using the same high density/elastic resin weight ratio (50/50) found in the dual drawtape samples were also produced. Referring to Table 5, the Comparative Examples included a 3 layer coextruded film containing high density and elastic resins defined in Table 2, and a monolayer blend also containing high density and elastic resins as defined in Table 2. Both comparative films had 3 mil (76.2 μm) thicknesses.

TABLE 5

| Comparative Examples | |
|---|---|
| Comparatives | Comparative Compositions |
| 3 Layer Coextruded Film (Thickness %: 25% Skin/ 50% Core/25% Skin) | Skin Layers: 100% Elastic Resin 1<br>Core Layer: ELITE 5960G |
| Monolayer Blend | 50% by wt. Elastic Resin 1<br>50% by wt. ELITE 5960G |

As shown in Table 6 below, the dual drawtapes were also evaluated against commercially available trash bags.

Experimental Results

Figure 4:
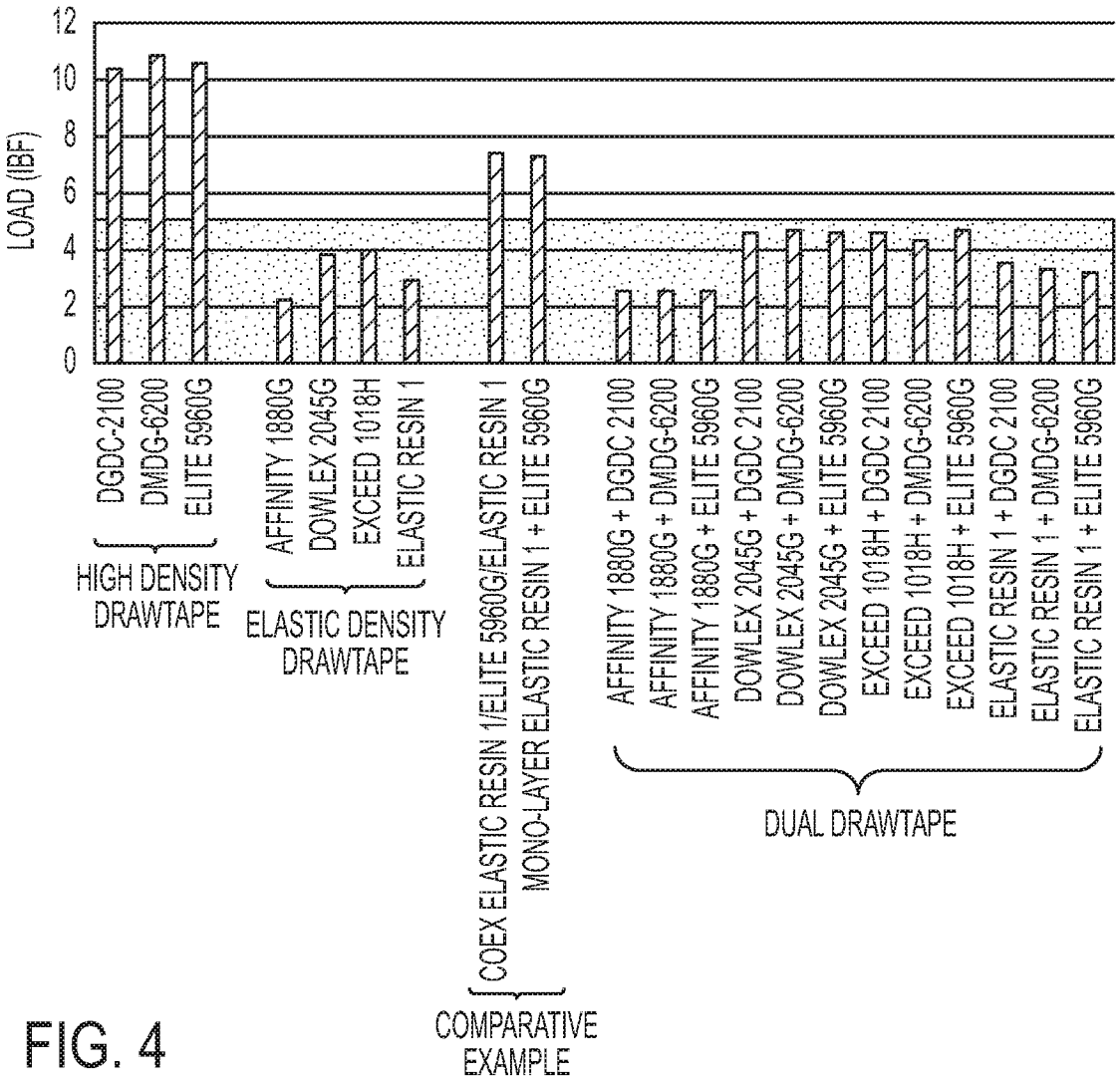

As shown in FIG. 4, the easy open functionality results show that high density drawtape requires extremely high load to stretch the film, while on the opposite of the spectrum, the load required for the elastic film was in the recommended range (below 5 lbs.).

In the dual drawtape examples, the easy open functionality remained in the recommended range. Without being bound by theory, this is believed to be possible due to the elastic portion of the drawtape doing most of the stretching while the high density tape remains relaxed. The dual drawtape examples kept the load low enough to remain in the recommended range.

When comparing dual drawtapes to comparative drawtapes, separating the individual elastic and high density components into individual films on opposite sides of the bag yielded superior performance over blended or multilayered films. Results show that comparative coextruded 3 layer drawtape trash bag and the comparative monolayer blend trash bag required a 7.3 lbf load, while dual drawtape trash bags with the same resins only required a 3.2 lbf load.

Figure 5:
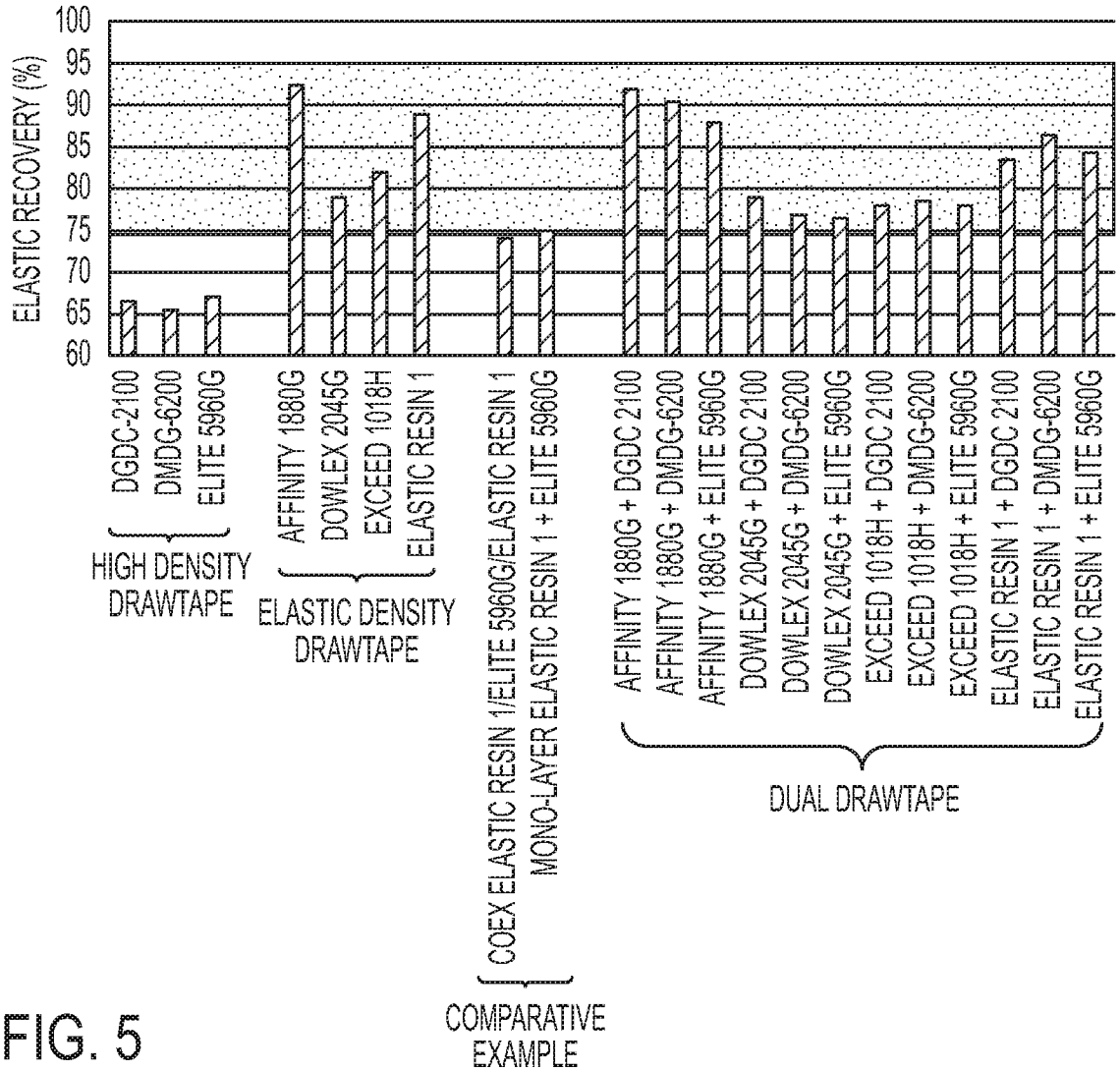
FIG. 5 is a bar chart illustrating the percent elastic recovery after elongation of the drawtapes in the Examples.

FIG. 5 summarizes the elastic recovery results obtained from the Stretch Hooder experiments. Similar to the elastic draw tapes, the elastic recovery for the dualdraw tapes ranged from 75-95%, depending on the density of the elastic film in the design. The high density draw tapes were ineffective as indicated by recovery values well below the desired range of at least 75%.

Figure 6:
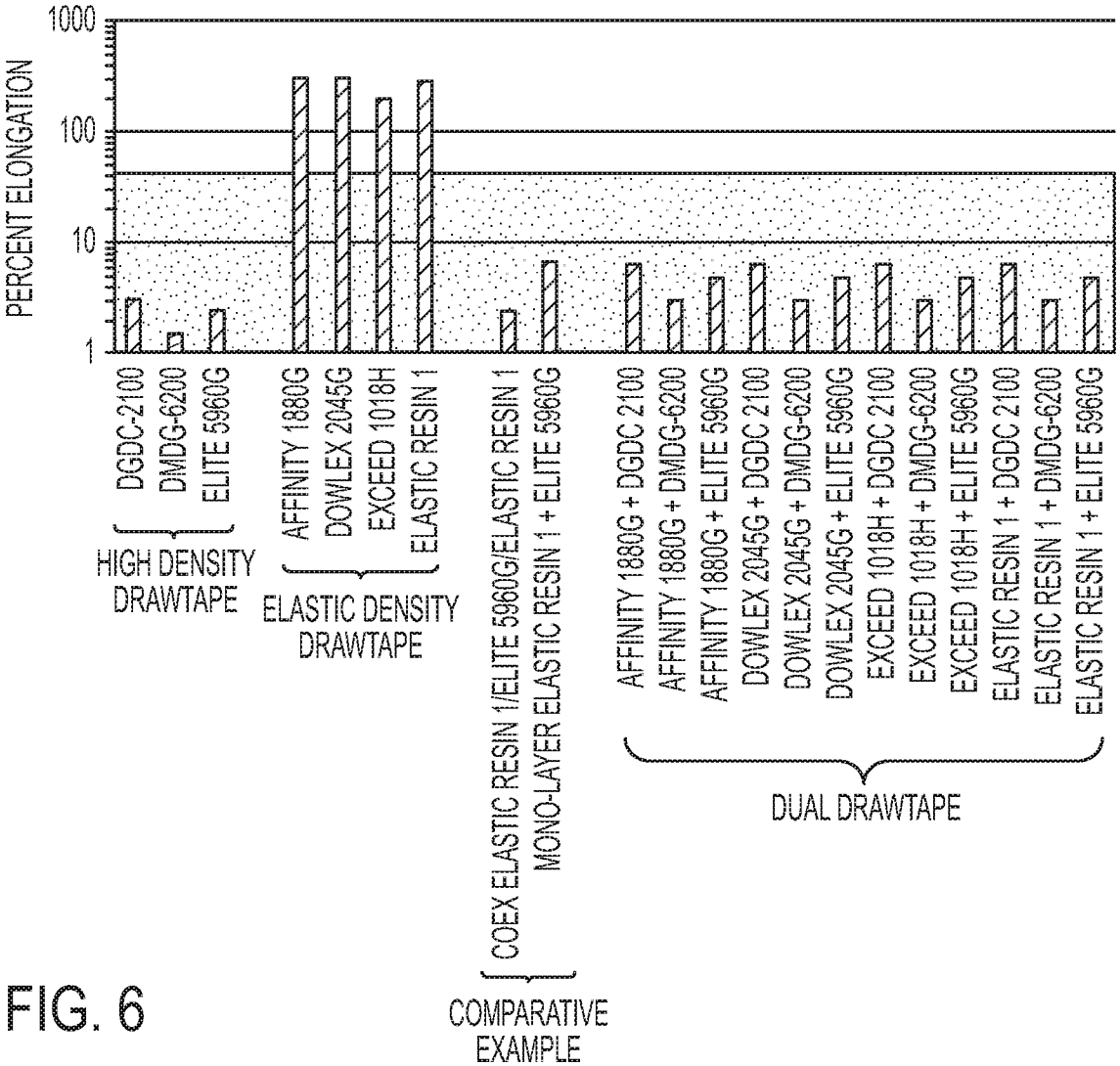
FIG. 6 is a bar chart illustrating the load carrying capability of the drawtapes in the Examples.

The tensile results of FIG. 6 summarize the load carrying capabilities of the different draw tapes. The rigidity/stiffness of the film is critical to carry the heavy load inside the trash bag without excessively stretching. As shown in FIG. 6, all the drawtape designs successfully carried the necessary load with the exception of the elastic films. The elastic draw tapes stretch up to 300%, which is unacceptable for a drawtape.

For the application tests conducted using the commercial bags of Table 6, the commercial trash bags used for these experiments were Glad® Guaranteed Strong™ (standard high density film draw tapes) and Great Value™ (elastic film draw tapes).

TABLE 6

| Film | Test 1 | Test 2 | Test 3 | Test 4 |
|---|---|---|---|---|
| High Density Drawtape (Glad ® Guaranteed Strong ™ Commercial Trash Bag) | Fail | Fail | Fail | Fail |
| Elastic Drawtape (Great Value ™ Commercial Trash Bag) | Pass | Pass | Pass | Pass |
| Dual Drawtape (Elastic Drawtape: Elastic Resin 1 + High Density Drawtape: ELITE 5960G) | Pass | Pass | Pass | Pass |

Figure 7:
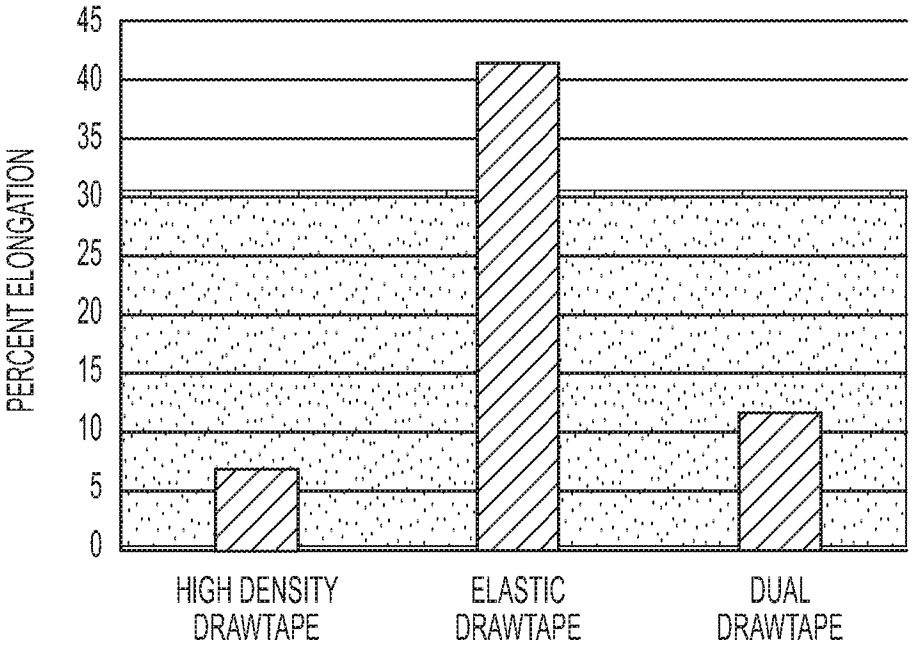
FIG. 7 is a bar chart illustrating the load carrying capability of a dual drawtape trash bag in accordance with the present embodiments in comparison to conventional trash bags having standard drawtape or elastic drawtape.

As shown in FIG. 7, liner trash bags with high density drawtapes yield good tensile performance; the drawtape strip does not elongate excessively upon lifting the weight. The elastic drawtapes elongated beyond 30%, which can become an inconvenience for consumers when carrying the trash bag. The dual drawtapes (high density+elastic) design had a middle ground performance, while still remaining below the required elongation threshold of 30%.

Table 6 summarizes the results from the performed gripping tests. High density draw tapes (Glad) failed the gripping test, as the trash bags collapsed into the receptacle when a heavy weight was placed. The elastic drawtapes (Great Value) passed, and the dual drawtape bags also passed the gripping test as well.

In conclusion, both experimental and application tests show the differentiation of dual drawtape over other drawtape solutions. Specifically, the dual drawtape examples met all three requirements—minimized elongation, ease of opening and elastic recovery. For example, the dual drawtape thermoplastic bags required less than 5 lbf load force to open. Moreover, the dual drawtape thermoplastic bags had a percent elastic recovery of at least 75%. Finally, the dual drawtape thermoplastic bags had percent elongations of less than 30%.

In contrast, the high density drawtapes are superior in load carrying by having little elongation; however, fail in the remaining 2 criteria—ease of opening and elastic recovery. Conversely, the elastic drawtapes easily stretched at low strains (easy open) and demonstrated good elastic recovery, but elongated excessively upon lifting average trash bag weights. Comparative drawtapes that combined both high density and elastic resins through blending or multi-layer structures were too stiff, similar to the high density film.

It will be apparent that modifications and variations are possible without departing from the scope of the disclosure defined in the appended claims. More specifically, although some aspects of the present disclosure are identified herein as preferred or particularly advantageous, it is contemplated that the present disclosure is not necessarily limited to these aspects.

The invention claimed is:

1. A thermoplastic bag comprising:

a first panel and a second panel, the first panel and the second panel joined together at a first side edge, a second side edge, and a bottom edge, wherein the first panel and the second panel define an opening along respective top edges of the first panel and the second panel and define a closed end along the bottom edge;

a first hem defining a first channel, the first hem being formed along the top edge of the first panel;

a second hem defining a second channel, the second hem being formed along the top edge of the second panel;

a first drawtape disposed within the first channel, wherein the first drawtape comprises a linear low density polyethylene having a density of from 0.902 g/cc to 0.920 g/cc, wherein the first drawtape comprises greater than 55 wt. %, based on the total weight of polymers present in the first drawtape, of the linear low density polyethylene; and a second drawtape disposed within the second channel, wherein the second drawtape comprises a high density polyethylene having a density of from 0.940 g/cc to 0.965 g/cc, wherein the second drawtape comprises greater than 55 wt. %, based on the total weight of polymers present in the second drawtape, of the high density polyethylene; and wherein the first drawtape, the second drawtape, or both comprise monolayer and multilayer films.

2. The thermoplastic bag of claim 1, wherein the first drawtape, the second drawtape, or both comprise monolayer and coextruded films.

3. The thermoplastic bag of claim 1, wherein the first panel has a first drawtape access hole located along the top edge of the first panel, wherein the first drawtape access hole permits exterior access to the first drawtape.

4. The thermoplastic bag of claim 3, wherein the second panel has a second drawtape access hole located along the top edge of the second panel, wherein the second drawtape access hole permits exterior access to the second drawtape.

5. The thermoplastic bag of claim 1, wherein the linear low density polyethylene has a melt index, $I_2$, of less than 10 g/10 min when measured according to ASTM D1238 at 190° C. and 2.16 kg load.

6. The thermoplastic bag of claim 1, wherein the linear low density polyethylene has a density of from 0.902 g/cc to 0.918 g/cc.

7. The thermoplastic bag of claim 1, wherein the high density polyethylene has a melt index, $I_2$, of less than 10 g/10 min.

8. The thermoplastic bag of claim 1, wherein the first drawtape comprises greater than 80 wt. %, based on the total weight of polymers present in the first drawtape, of the linear low density polyethylene, and wherein the second drawtape comprises greater than 80 wt. %, based on the total weight of polymers present in the second drawtape, of the high density polyethylene.

9. The thermoplastic bag of claim 1, wherein the linear low density polyethylene has a melt index, $I_2$, of 0.1 to 2 g/10 min.

10. The thermoplastic bag of claim 1, wherein the high density polyethylene has a melt index, $I_2$, of 0.01 to 1 g/10 min.

* * * * *